US009849472B2

(12) United States Patent
Ayers

(10) Patent No.: US 9,849,472 B2
(45) Date of Patent: Dec. 26, 2017

(54) DUAL CONTROL SPRAY NOZZLE WITH DETACHABLE HEAD

(71) Applicant: Glenn A. Ayers, Pompano Beach, FL (US)

(72) Inventor: Glenn A. Ayers, Pompano Beach, FL (US)

( * ) Notice: Subject to any disclaimer, the term of this patent is extended or adjusted under 35 U.S.C. 154(b) by 0 days.

(21) Appl. No.: 15/054,957

(22) Filed: Feb. 26, 2016

(65) Prior Publication Data

US 2016/0250651 A1 Sep. 1, 2016

Related U.S. Application Data

(60) Provisional application No. 62/121,155, filed on Feb. 26, 2015.

(51) Int. Cl.

| | |
|---|---|
| ***B05B 7/02*** | (2006.01) |
| ***B05B 1/30*** | (2006.01) |
| ***B05B 1/16*** | (2006.01) |
| ***B05B 9/01*** | (2006.01) |
| ***B05B 15/06*** | (2006.01) |
| ***B05B 1/12*** | (2006.01) |

(52) U.S. Cl.

CPC ..... *B05B 1/3026* (2013.01); *B05B 1/12* (2013.01); *B05B 1/16* (2013.01); *B05B 9/01* (2013.01); *B05B 15/061* (2013.01)

(58) Field of Classification Search

CPC ..... B05B 9/01; B05B 15/061; B05B 1/16; B05B 15/065; B05B 1/3026; B05B 1/12

USPC ..... 239/390, 391, 397, 439, 447, 525, 530, 239/581.1

See application file for complete search history.

(56) References Cited

U.S. PATENT DOCUMENTS

| | | | | | |
|---|---|---|---|---|---|
| 3,319,893 | A * | 5/1967 | Rodgers et al. | B05B 1/1636 | 239/581.1 |
| 3,967,783 | A * | 7/1976 | Halsted | B05B 1/1663 | 239/447 |
| 4,151,957 | A * | 5/1979 | Gecewicz | B05B 1/1663 | 239/530 |
| 5,033,897 | A * | 7/1991 | Chen | A46B 11/063 | 239/447 |
| 5,964,415 | A * | 10/1999 | Hadar | B05B 1/1654 | 239/391 |

* cited by examiner

*Primary Examiner* — Steven J Ganey
(74) *Attorney, Agent, or Firm* — Kintner IP, LLC; Mary Frances Ludwig

(57) ABSTRACT

A handheld sprayer nozzle is provided that has dual levers connected to an internal rotary valve for easily and comfortably controlling and turning on and off the flow of water or other liquid or fluid emitted through the sprayer nozzle and out of its head from either side of the sprayer regardless of the orientation of the sprayer head relative to a user holding the sprayer nozzle. The handheld sprayer nozzle is connectable to an end of a pressurized hose. The sprayer nozzle's dual control levers are located on opposite sides of the sprayer nozzle so as to be generally located in positions opposite to one another and may be easily operated from either side of the sprayer nozzle by a user's thumb. The sprayer nozzle's head is also detachable so that sprayer heads of different lengths and spray patterns can be attached to the sprayer nozzle for different uses.

18 Claims, 5 Drawing Sheets

DUAL CONTROL SPRAY NOZZLE WITH DETACHABLE HEAD

CROSS-REFERENCE TO RELATED APPLICATIONS

This application is a nonprovisional application of and claims priority from U.S. provisional patent application Ser. No. 62/121,155 filed on Feb. 26, 2015. The foregoing application is incorporated in its entirety herein by reference.

FIELD OF THE INVENTION

The invention relates to a sprayer nozzle that is connectable to an end of a pressurized hose. More particularly, the invention relates to a handheld water sprayer nozzle connectable to an end of a pressurized water hose and having dual control levers connected to a rotational internal valve that can be controlled by only a user's thumb to comfortably and easily turn on and off water pressure through the sprayer nozzle and one or more detachable heads that vary in certain parameters.

BACKGROUND

Conventional handheld water sprayers, also called nozzles, that are connectable to a pressurized hose and that have a rotary or spring valve to control the spray pressure generally include only one pressure control lever or button. This single control lever or button is typically located on one side of the sprayer. A problem arises with only having one control lever or button on one side of the sprayer when a user flips over or inverts the sprayer so that the spray head is oriented to spray water in a vertical or upward direction or angle. When held by a user in this orientation, conventional sprayers are difficult and very uncomfortable for the user to hold and control while pushing the lever or button to spray water upward, for example, when trying to spray under a car or other low downward-facing surface. The spray nozzle may also be attached to a hose for use as a hand-held bidet for spraying water under and onto a perineal area of user who is sitting on a toilet. In addition, conventional handheld sprayers do not have a detachable spray head that permits different length spray heads and different spray patterns to be attached for multiple uses.

A need exists for a dual control sprayer nozzle that a user can easily and comfortably hold, control, and operate in different orientations including, without limitation, an inverted upward orientation, using only the user's thumb. A need also exists for a sprayer nozzle that permits the attachment of various detachable spray heads having different lengths and spray patterns suitable for different uses.

SUMMARY

The invention relates to a sprayer nozzle that is connectable to an end of a pressurized hose, wherein the sprayer nozzle has dual (two) levers for controlling the flow of water emitted through the sprayer nozzle and out of its head and for turning on and off the flow of water through the sprayer nozzle. In exemplary embodiments, the levers protrude from the sprayer nozzle in opposite directions on opposing sides of the sprayer nozzle so that either lever may be easily operated by only a thumb of a user, however, the levers can also be operated using another finger or other part of the user's hand. For purposes of convenience and without limiting the scope of the invention, operation of the sprayer nozzle's levers may be described herein with reference to the user's thumb with the understanding that the user could use another finger or part of the user's hand. The handheld water sprayer nozzle is connectable to an end of a pressurized water hose or other type of hose. The sprayer nozzle's dual control levers are located on opposite sides of the sprayer nozzle so as to be generally located in positions opposite to one another for easy and comfortable operation by the user using a thumb from either side of the sprayer nozzle.

The sprayer nozzle provides an advantage over conventional handheld sprayers by its use of a rotary or spring valve that permits a user to comfortably hold the sprayer in multiple spray positions and easily control the spray flow and pressure from both sides of the sprayer. For example, while a sprayer nozzle is often oriented for spraying purposes in a direction that is generally horizontally away from the user, the user may also find it necessary to hold the sprayer nozzle so that it is oriented for spraying purposes in a direction so that a head of the sprayer nozzle points generally vertically or at an upward angle relative to the user. Conventional water sprayers are difficult to hold and control in such orientations while keeping their control lever depressed and maintaining control over movement of the sprayer and pressurized hose as water passes through them.

The sprayer nozzle also provides an advantage in that the user can control the flow of water (including turning on and off the flow or otherwise adjusting the flow) from the sprayer nozzle from two opposing sides of the sprayer nozzle by operation of the one of the opposing dual levers that is most easily reached by a thumb of the user. The dual opposing levers allow the user to easily and comfortably control the flow of water out of the sprayer nozzle from any orientation in which the sprayer nozzle may be held by the user. The levers are constructed so that the user needs to use only a thumb to control and operate each lever.

The sprayer nozzle also provides an advantage by allowing the interchangeable attachment and detachment of one or more spray shafts that can be constructed to vary in shape, size, length, and configuration of spray pattern through location, size, and arrangement of spray apertures in a head of the spray shaft so as to be suitable for any number of different uses.

Accordingly, the invention features a sprayer nozzle that includes a first lever and an opposing second lever for turning on and off and controlling a flow of liquid from a spray head of the sprayer nozzle by operation of the first lever or second lever from either side of the sprayer nozzle.

In another aspect, the invention can feature the first lever and second lever being manually adjustable from any orientation of the sprayer nozzle when held in a hand of a user.

In another aspect, the invention can feature the first lever and second lever being tabs that can protrude from a rotatable lever.

In another aspect, the invention can feature the first lever and second lever being oriented in a plane that is generally the same as that of front and rear faces of a head of the sprayer nozzle.

In another aspect, the invention can feature the first lever and second lever being oriented in a plane that is generally perpendicular to a plane in which front and rear faces of a head of the sprayer nozzle are oriented.

In another aspect, the invention can feature the first lever and second lever being manipulable by one or more thumbs, fingers, or hands of a user to turn on, turn off, and control the flow of fluid through the sprayer nozzle that is emitted out of a head of the sprayer nozzle.

In another aspect, the invention can feature the first lever and second lever being adjustable to open, close, and control a volume of fluid passing through a rotary valve.

The invention also features a sprayer nozzle that can include one or more detachable spray shafts.

In another aspect, the invention can feature a first lever and an opposing second lever for turning on and off and controlling a flow of liquid from a spray head of the sprayer nozzle by operation of the first lever or second lever from either side of the sprayer nozzle.

In another aspect, the invention can feature the first lever and second lever being manually adjustable from any orientation of the sprayer nozzle when held in a hand of a user.

In another aspect, the invention can feature the one or more detachable spray shafts being attachable and detachable to and from a second end of a sprayer shaft of the sprayer nozzle.

In another aspect, the invention can feature the one or more detachable spray shafts being constructed to vary in shape, size, length, and configuration of spray pattern through location, size, and arrangement of spray apertures in a head of the spray shaft.

In another aspect, the invention can feature the first lever and second lever being tabs protruding from a rotatable lever.

In another aspect, the invention can feature the first lever and second lever being oriented in a plane that is generally the same as that of front and rear faces of a head of the sprayer nozzle.

In another aspect, the invention can feature the first lever and second lever being oriented in a plane that is generally perpendicular to a plane in which front and rear faces of a head of the sprayer nozzle are oriented.

The invention also features a sprayer nozzle that includes a first lever and an opposing second lever for turning on and off and controlling a flow of liquid from a spray head of the sprayer nozzle by operation of the first lever or second lever from either side of the sprayer nozzle and one or more detachable spray shafts.

In another aspect, the invention can feature the first lever and second lever being manually adjustable from any orientation of the sprayer nozzle when held in a hand of a user.

In another aspect, the invention can feature the one or more detachable spray shafts being attachable and detachable to and from a second end of a sprayer shaft of the sprayer nozzle and being constructed to vary in shape, size, length, and configuration of spray pattern through location, size, and arrangement of spray apertures in a head of the spray shaft.

In another aspect, the invention can feature the first lever and second lever being tabs protruding from a rotatable lever.

In another aspect, the invention can feature the first lever and second lever being oriented in a plane that is generally the same as or generally perpendicular to a plane in which front and rear faces of a head of the sprayer nozzle are oriented.

Unless otherwise defined, all technical terms used herein have the same meaning as commonly understood by one of ordinary skill in the art to which this invention belongs. Although methods and materials similar or equivalent to those described herein can be used in the practice or testing of the present invention, suitable methods and materials are described below. All publications, patent applications, patents and other references mentioned herein are incorporated by reference in their entirety. In the case of conflict, the present specification, including definitions will control.

DETAILED DESCRIPTION

Figure 1:
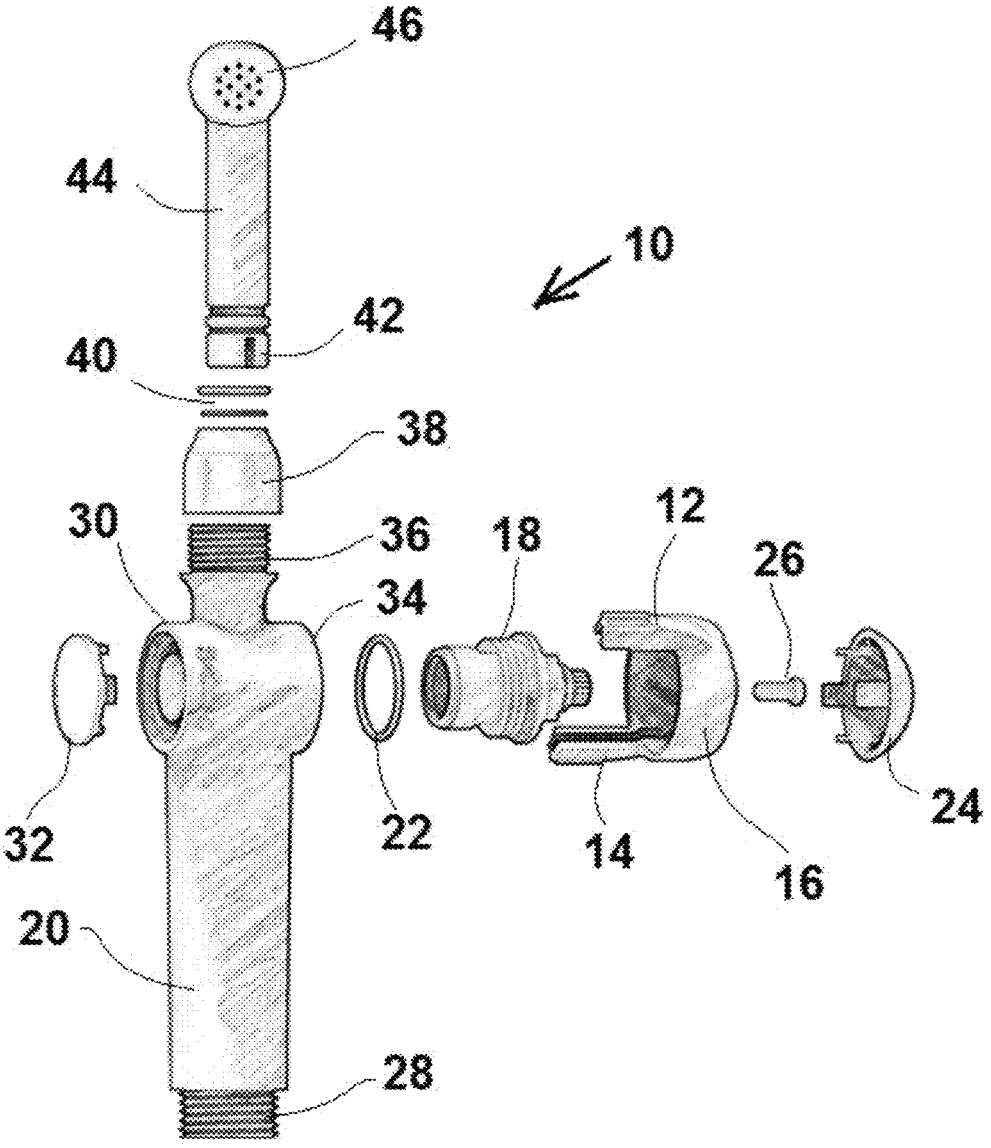
FIG. 1 is an exploded front perspective view of a spray nozzle with dual controls and one embodiment of a detachable head.

The present invention is best understood by reference to the detailed drawings and description set forth herein. Embodiments of the invention are discussed below with reference to the drawings; however, those skilled in the art will readily appreciate that the detailed description given herein with respect to these figures is for explanatory purposes as the invention extends beyond these limited embodiments. For example, in light of the teachings of the present invention, those skilled in the art will recognize a multiplicity of alternate and suitable approaches, depending upon the needs of the particular application, to implement the functionality of any given detail described herein beyond the particular implementation choices in the following embodiments described and shown. That is, numerous modifications and variations of the invention may exist that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

The present invention should not be limited to the particular methodology, compounds, materials, manufacturing techniques, uses, and applications, described herein, as these may vary. The terminology used herein is used for the purpose of describing particular embodiments only, and is not intended to limit the scope of the present invention. As used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" may be a reference to one or more steps or means and may include sub-steps and subservient means.

All conjunctions used herein are to be understood in the most inclusive sense possible. Thus, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should be read as "and/or" unless expressly stated otherwise. Structures described herein are to be understood also to refer to functional equivalents of such structures. Language that may be construed to express approximation should be so understood unless the context clearly dictates otherwise.

Unless otherwise defined, all terms (including technical and scientific terms) are to be given their ordinary and customary meaning to a person of ordinary skill in the art, and are not to be limited to a special or customized meaning unless expressly so defined herein.

Terms and phrases used in this application, and variations thereof, especially in the appended claims, unless otherwise expressly stated, should be construed as open ended as opposed to limiting. As examples of the foregoing, the term "including" should be read to mean "including, without limitation," "including but not limited to," or the like; the term "having" should be interpreted as "having at least"; the term "includes" should be interpreted as "includes but is not limited to"; the term "example" is used to provide exemplary instances of the item in discussion, not an exhaustive or limiting list thereof; and use of terms like "preferably," "preferred," "desired," "desirable," or "exemplary" and words of similar meaning should not be understood as implying that certain features are critical, essential, or even important to the structure or function of the invention, but instead as merely intended to highlight alternative or additional features that may or may not be utilized in a particular embodiment of the invention.

Those skilled in the art will also understand that if a specific number of an introduced claim recitation is intended, such an intent will be explicitly recited in the claim, and in the absence of such recitation no such intent is present. For example, as an aid to understanding, the appended claims may contain usage of the introductory phrases "at least one" and "one or more" to introduce claim recitations; however, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C" is used, in general, such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.).

All numbers expressing dimensions, quantities of ingredients, reaction conditions, and so forth used in the specification are to be understood as being modified in all instances by the term "about" unless expressly stated otherwise. Accordingly, unless indicated to the contrary, the numerical parameters set forth herein are approximations that may vary depending upon the desired properties sought to be obtained.

The invention provides a sprayer nozzle that is connectable to an end of a pressurized hose. The sprayer nozzle can be connectable to an end of a pressurized hose (for example, a water hose) and can have dual control levers. The dual control levers can protrude from opposite sides of the sprayer nozzle so as to be easily operable from either side of the sprayer nozzle no matter the orientation in which it is held and can be optimally sized and shaped for operation by a user's thumb. In exemplary embodiments described herein, and for purposes of convenience but without limiting the invention, the sprayer nozzle can be one that is used for spraying water from a water hose. In other embodiments, the sprayer nozzle may be adapted for spraying other liquids or fluids, for example, liquid chemicals of any type capable of being sprayed. In exemplary embodiments, the pressurized hose is a water hose (e.g., a conventional garden hose) capable of conveying water to transit therethrough and out of at least one end. However, in other embodiments, the pressurized hose may be any other type of hose that is capable of conveying a liquid or other fluid therethrough and out of at least one end (e.g., a fire hose, a pressure washer hose, a hose capable of conveying liquid chemicals, or any other type of hose that can convey a sprayable liquid or fluid).

Figure 2:
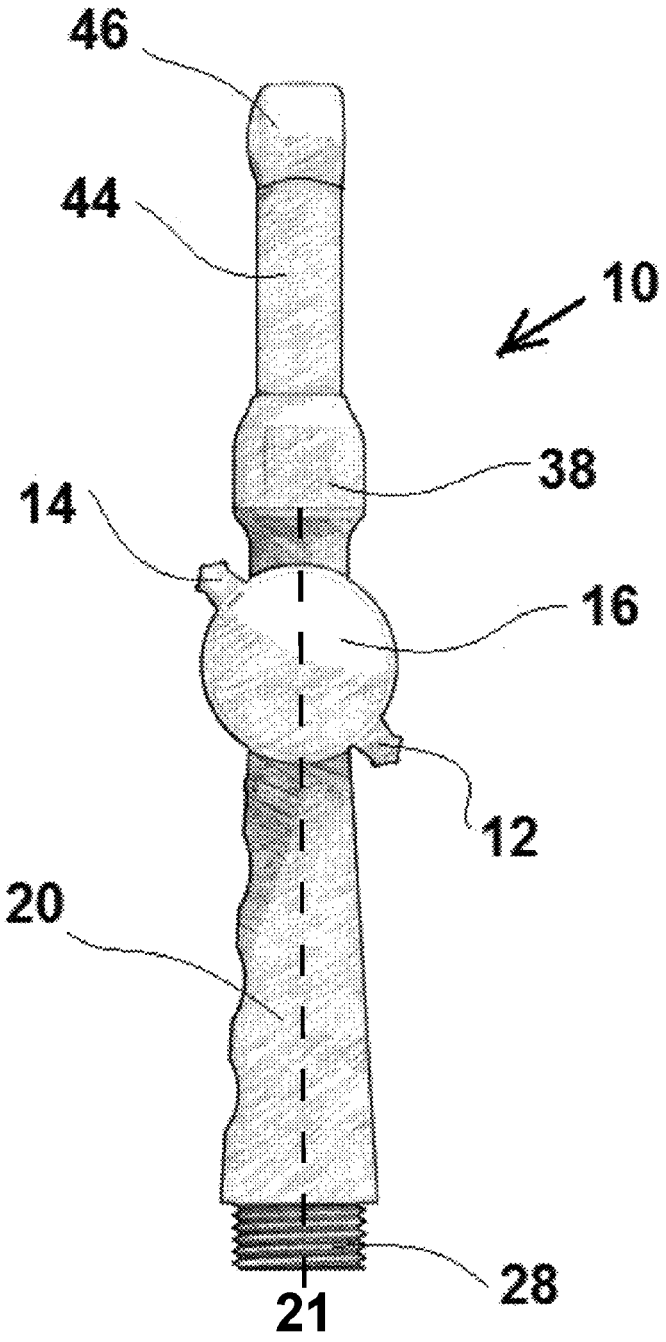
FIG. 2 is a left side elevation view of the spray nozzle and detachable head of FIG. 1.

The sprayer nozzle 10 can include dual controls, which can be a first lever and a second lever. The first and second levers can be opposed, i.e., oriented to protrude from opposite sides of the sprayer nozzle so that at least one of the levers is easily operated by the user (e.g., by the user's thumb) no matter in which orientation the sprayer nozzle is held by the user in relation to the user's hand or body. The first and second levers of the sprayer nozzle 10 can be ergonomically designed for easy and comfortable use and control by a user who may operate the levers by pressing, pulling, or turning them with a finger, thumb, or hand. In an exemplary embodiment, the sprayer nozzle can include a first lever 12 that is a front pressure control lever 12 and a second lever 14 that is a rear pressure control lever 14 as shown in FIGS. 1 and 2. The front pressure control lever 12 and rear pressure control lever 14 can be opposing parts of a unitary single piece that is a manually rotatable lever 16 as shown in FIG. 1. For example, the front pressure control lever 12 and rear pressure control lever 14 can be opposing tabs that extend off of the manually rotatable lever 16 as shown in FIGS. 1-5. The tabs of the front pressure control lever 12 and rear pressure control lever 14 can be opposed about a central longitudinal axis 21 of handle grip 20, as shown in FIG. 2. The opposing tabs of the front pressure control lever 12 and rear pressure control lever 14 can be easily reached and operated by the user regardless of the orientation in which the sprayer nozzle is held because at least one lever would be within close reach of the user's thumb at all times and from any side of the sprayer nozzle.

In another embodiment, the front pressure control lever 12 and rear pressure control lever 14 can be two components connected together to form a manually rotatable lever. In still another embodiment, the front pressure control lever 12 and rear pressure control lever 14 can be separate pieces that are independently operable rather than being part of a unitary rotatable lever or connected together to form a rotatable lever. The manually rotatable lever 16 can be generally circular when viewed from a front side orientation as shown in FIG. 2. In other embodiments, the manually rotatable lever 16 can have other shapes when viewed from a front side orientation, e.g., elliptical, irregular, quadrilateral, pentagonal, hexagonal, heptagonal, octagonal, or any other suitable shape.

In the exemplary embodiment illustrated in the drawings, the first and second levers 12 and 14 can be oriented as front and rear pressure control levers so that when the sprayer nozzle 10 is held by a user, the first lever 12 is oriented away from the user toward a front side of the sprayer nozzle, e.g., in the direction in which water sprayed from a head 46 of the sprayer nozzle would be emitted. The second lever 14 can be oriented toward a rear side of the sprayer nozzle 10 in the direction of the user when the user is holding the sprayer nozzle. In this embodiment, the user can manipulate both the first and second levers 12 and 14 when holding the sprayer nozzle 10 by grasping the levers with the user's hand and/or fingers to manipulate the lever between its on and off positions and in intermediate positions to adjust the flow of water from no flow to intermediate levels of water flow to maximum flow. For example, by pressing down on the first lever (or by pulling up on the second lever, or by both pressing down on the first lever while pulling up on the second lever), the sprayer nozzle can be configured in the off or closed position so that water (or other liquid or fluid) flow is stopped and no water is emitted from the sprayer head 46. Alternatively, by pressing down on the second lever (or by pulling up on the first lever, or by both pressing down on the second lever while pulling up on the first lever), the sprayer nozzle can be configured in the on or open position so that water (or other liquid or fluid) flow is started and is emitted through the sprayer nozzle 10 and out of its head 46. The head 46 can include any number, pattern, or configuration of spray apertures through which water (or other liquid or fluid) can be emitted when the sprayer nozzle is in use.

In another embodiment, rather than the first and second levers being oriented in a plane that corresponds to the rear of the head 46 and the front of the head on which the spray apertures are located, the first lever 12 and second lever 14 can be oriented in a plane that is perpendicular to the front and rear of the head. In this embodiment, the first and second levers 12 and 14 can still be operated in the manners explained above, or the user may manually grasp the first and second levers and rotate them counterclockwise (or to the left) to configure the sprayer nozzle 10 in the off or closed position so that water (or other liquid or fluid) flow is stopped and no water is emitted from the sprayer head 46. The user may rotate the first and second levers 12 and 14 clockwise (or to the right) to configure the sprayer nozzle 10 in the on or open position so that water (or other liquid or fluid) flow is started and is emitted through the sprayer nozzle 10 and out of its head 46. In other embodiments, the direction of rotation to change the configuration of the sprayer nozzle 10 from its closed/off to open/on positions and vice versa may be reversed, i.e., rotatable counterclockwise for the open/on position and clockwise for the closed/off position.

Thus, the sprayer nozzle 10 can be constructed so that the first and second levers 12 and 14 are opposing in orientation relative to one another so that one of them protrudes from one side of the sprayer nozzle and the other protrudes from the opposite side of the sprayer nozzle. For example, in one embodiment as shown in FIGS. 1-5, the first lever 12 can protrude and be operable from a front side of the sprayer nozzle while the second lever 14 can protrude and be operable from a rear side of the sprayer nozzle. In another embodiment, the first lever 12 can protrude and be operable from a rear side of the sprayer nozzle while the second lever 14 can protrude and be operable from a front side of the sprayer nozzle. In still another embodiment, the first lever 12 can protrude and be operable from a left side of the sprayer nozzle while the second lever 14 can protrude and be operable from a right side of the sprayer nozzle. In yet another embodiment, the first lever 12 can protrude and be operable from a right side of the sprayer nozzle while the second lever 14 can protrude and be operable from a left side of the sprayer nozzle. In each of these embodiments, the user can easily reach at least one of the levers with the user's thumb for operation of the lever to control water flow using manipulation of the lever to adjust the internal rotational valve to increase or decrease water pressure passing through the valve.

By adjusting the position of the first and second levers 12 and 14 at any position intermediate between the totally closed/off position and the totally open/on position, the user may also control the amount of flow of water (or other liquid or fluid) emitted from the head 46 of the sprayer nozzle 10.

Figure 5:
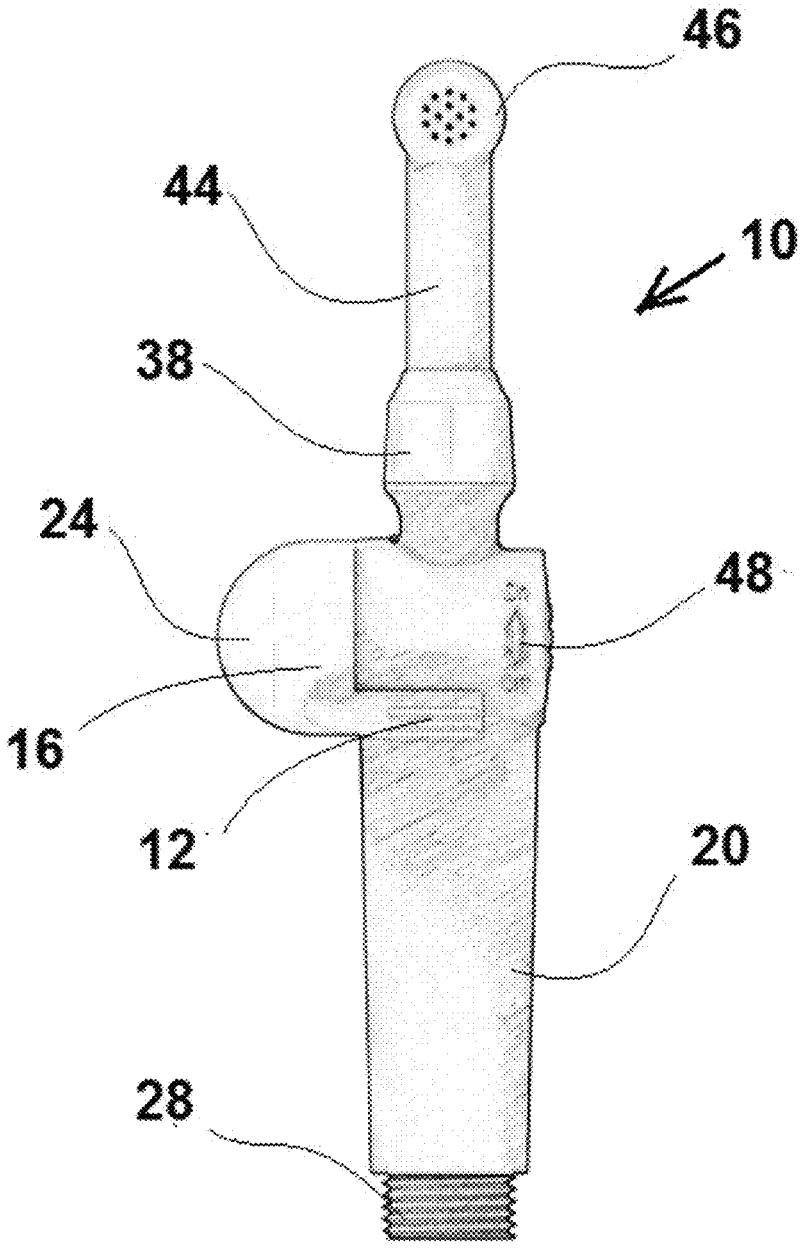
FIG. 5 is a front elevation view of the spray nozzle and detachable head of FIG. 1.

The front pressure control lever 12 and rear pressure control lever 14 (and therefore, in exemplary embodiments, the manually rotatable lever 16) are attached to a rotary valve 18 using a screw 26 that is insertable through a front aperture of the rotatable lever 16 to be aligned with and screwed into a corresponding center front aperture of the rotary valve assembly cartridge. The rotary valve 18 (also referred to herein as a rotational valve) can be a rotary valve assembly cartridge (as shown in the drawings, e.g., a ceramic valve cartridge), a ball valve, or any other rotary or rotating pressure control valve capable of being controlled manually by a user's thumbs, fingers, or hand. In some embodiments, a screw cover 24 may be permanently or detachably affixed to a front face of the manually rotatable lever 16 so as to conceal a head of the screw 26 after the screw is threaded through the front aperture of rotatable lever 16 and into the center front aperture of the rotary valve 18 to connect rotatable lever to the rotary valve. The screw cover 24 can have a shape that differs from the shape of the manually rotatable lever 16 when viewed from a front side orientation. However, in exemplary embodiments, the screw cover can have a shape that corresponds to and matches the shape of the manually rotatable lever 16, e.g., the screw cover can be generally circular when viewed from a front side orientation as shown in FIGS. 2 and 5. In other embodiments, the screw cover 24 can have other shapes when viewed from a front side orientation, e.g., elliptical, irregular, quadrilateral, pentagonal, hexagonal, heptagonal, octagonal, or any other suitable shape, which may match or be different than the shape of the manually rotatable lever 16.

Figure 3:
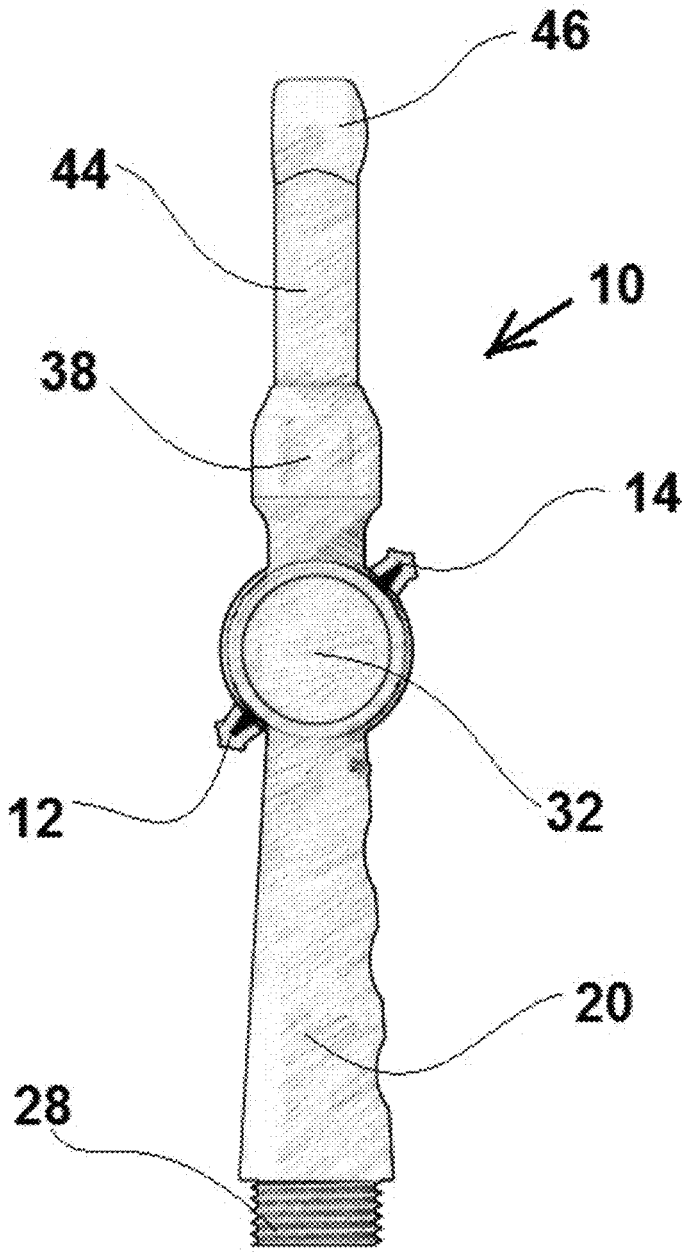
FIG. 3 is a right side elevation view of the spray nozzle and detachable head of FIG. 1.

The rotary valve 18 is sealed to a first aperture 34 of a multi-directional handle grip 20 by an at least first O-ring seal 22. A second aperture 30 located on a side of the multi-directional handle grip 20 opposite from the first aperture 34 can be covered and concealed by a side cover 32 as shown in FIGS. 1 and 3. The handle grip 20 can be constructed to allow for easy and ergonomic handling for manual grasping, manipulation, and control by a user. For example, the handle grip 20 can include indentions that allow for firm gripping by the fingers of the user. A first end 28 of the of handle grip 20 can include threads for attaching the sprayer nozzle 10 to a hose (not shown in the drawings). A second end 36 of the handle grip 20 can include threads for attaching a nut 38 that is used to connect a spray shaft 44. The head (also referred to herein as a sprayer head) 46 can be a first end of the spray shaft 44.

The sprayer nozzle 10 can also include at least a second (and as shown in FIG. 1, an optional at least third) O-ring 40 that seals a second end 42 (which may include threads) of the spray shaft 44 to the nut 38 as shown in FIG. 1. In another embodiment, the second end 42 of the spray shaft 44 may attach (e.g., by screwing) directly onto the second end 36 of the handle grip 20.

The spray shaft 44 of the sprayer nozzle 10 can be detachable so that any number of sprayer shafts of various lengths, shapes, sizes, and spray patterns of the head's apertures can be provided for attachment to the handle grip 20 for use in different applications. For example, in one embodiment, a longer spray shaft 44 may be needed, e.g., one that is 6, 7, 8, 9, 10, 11, 12, 14, 16, 18, 20, 24, 36, or more inches long, may be needed for extended reach. In another example, a shorter spray shaft 44, e.g., 0.5, 1, 2, 3, 4, 5, or 6 inches long, may be necessary for standard use or for use in enclosed, small, or tight spaces. The apertures of the sprayer head 46 can be configured in any number, pattern, or arrangement as desired.

Figure 4:
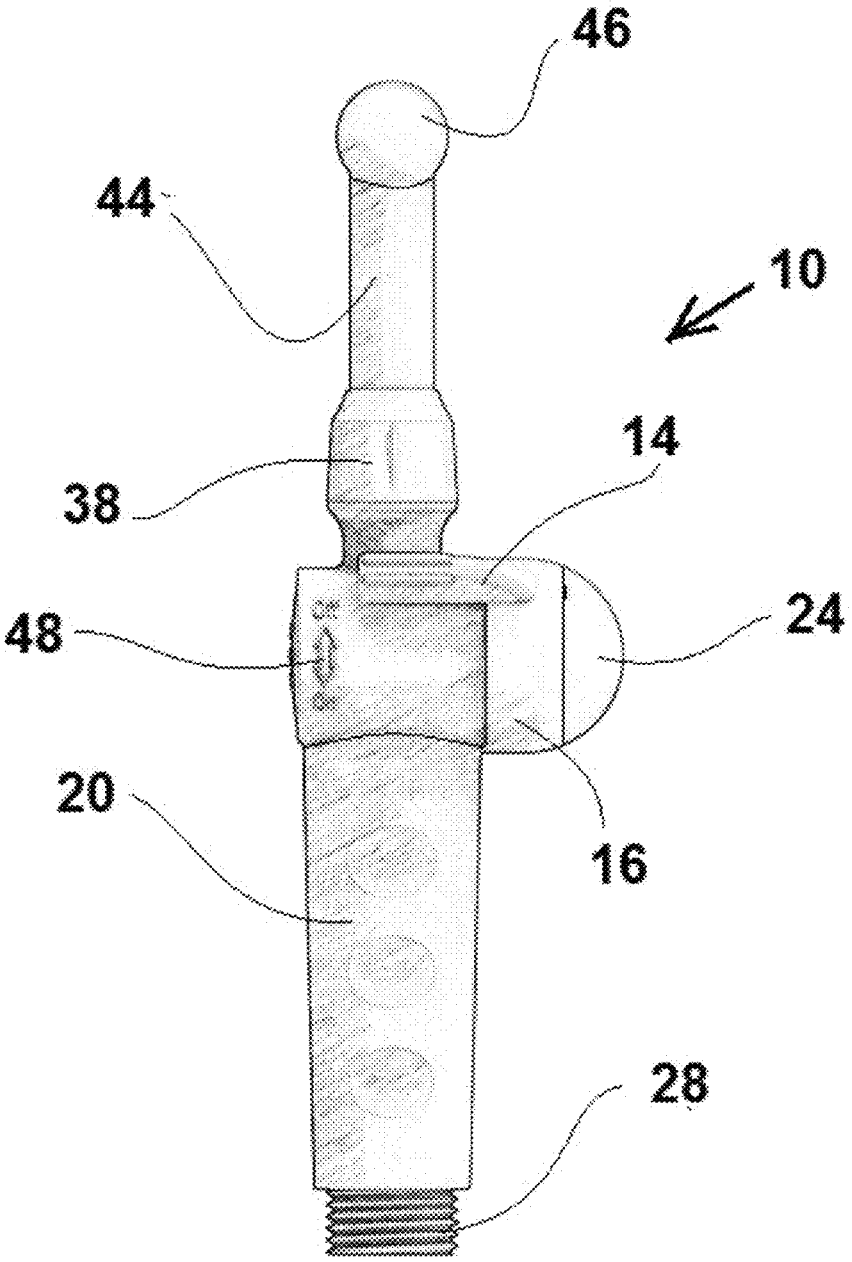
FIG. 4 is a rear elevation view of the spray nozzle and detachable head of FIG. 1.

As shown in FIGS. 4 and 5, the sprayer nozzle 10 can include markings 48 that include words or symbols indicating the direction that the first and second levers 12 and 14 must be moved to turn on and off the rotary valve 18 and to start, stop, and control the flow of water or other liquid or fluid through the hose and out of the head 46 of the sprayer nozzle 10. For example, the markings 48 could include the words "ON" and "OFF." The markings 48 can also include a symbol such as a bidirectional arrow that indicates in which direction each lever must be moved to turn on and turn off water flow through the sprayer nozzle 10. FIG. 4 shows the second lever 14 in the closed/off position so that water would not be emitted through the sprayer nozzle 10 and out of its head 46. FIG. 5 also shows the first lever 12 in the closed/off position.

Other Embodiments

It is to be understood that while the invention has been described in conjunction with the detailed description thereof, the foregoing description is intended to illustrate and not limit the scope of the invention, which is defined by the scope of the appended claims. Other aspects, advantages, and modifications are within the scope of the following claims.

What is claimed is:

1. A sprayer nozzle for spraying a liquid from a cooperating hose, the sprayer nozzle comprising:

a handle grip having a central longitudinal axis, a first end configured for connection to the hose, a second end, and a first side and a second side opposed about the central longitudinal axis;

a spray head connected to the second end of the handle grip; and, a first lever and a second lever attached to the handle grip and interposed between the first end and the second end of the handle grip, the first lever protruding from the first side and the second lever protruding from the second side;

wherein each of the first lever and the second lever are configured to turn on and off and control the flow of liquid from the spray head of the sprayer nozzle.

2. The sprayer nozzle of claim 1, wherein the first lever and second lever are manually adjustable to control a volume of fluid passing through the spray head, the first and second levers manually adjustable from any orientation of the sprayer nozzle when held in a hand of a user.

3. The sprayer nozzle of claim 1, wherein the first lever and second lever are tabs protruding from a rotatable lever.

4. The sprayer nozzle of claim 1, the spray head having front and rear faces, wherein the first lever and second lever are oriented in a plane that is generally the same as that of the front and rear faces of the spray head.

5. The sprayer nozzle of claim 1, the spray head having front and rear faces, wherein the first lever and second lever are oriented in a plane that is generally perpendicular to a plane in which the front and rear faces of the spray head are oriented.

6. The sprayer nozzle of claim 1, wherein when the handle grip is held in a hand of a user, the first lever and second lever are both configured for manipulation by only a single finger of the hand holding the handle grip to turn on, turn off, and control the flow of fluid through the sprayer nozzle that is emitted out of the spray head.

7. The sprayer nozzle of claim 1, wherein the first lever and second lever are adjustable to open, close, and control a volume of fluid passing through a rotary valve interposed between the first end and the second end of the handle grip.

8. A sprayer nozzle system for spraying a liquid from a cooperating hose, the sprayer nozzle comprising:

a handle grip having a central longitudinal axis, a first end configured for connection to the hose, and a second end;

one or more detachable spray shafts each having a first end and a second end, each second end configured for attachment to and detachment from the second end of the handle grip;

a spray head configured for attachment to the first end of at least one of the one of more spray shafts; and, a first lever and a second lever attached to the handle grip, interposed between the first end and the second end of the handle grip, and opposed about the central longitudinal axis;

wherein the first lever and second lever are configured to turn on and off and control the flow of liquid from the spray head of the sprayer nozzle by operation of the first lever or second lever from either side of the sprayer nozzle.

9. The sprayer nozzle system of claim 8, wherein the first lever and second lever are manually adjustable to control a volume of fluid passing through the spray head, the first and second levers manually adjustable from any orientation of the sprayer nozzle when held in a hand of a user.

10. The sprayer nozzle system of claim 8, wherein the one or more detachable spray shafts are constructed of different shapes, sizes, or lengths.

11. The sprayer nozzle system of claim 8, further including one or more spray heads, wherein each of the one or more spray heads are configured to produce a different spray pattern through location, size, and arrangement of spray apertures in the spray head.

12. The sprayer nozzle system of claim 8, wherein the first lever and second lever are tabs protruding from a rotatable lever.

13. The sprayer nozzle system of claim 8, the spray head having front and rear faces, wherein the first lever and second lever are oriented in a plane that is generally the same as that of the front and rear faces of the spray head.

14. The sprayer nozzle system of claim 8, the spray head having front and rear faces, wherein the first lever and second lever are oriented in a plane that is generally perpendicular to a plane in which the front and rear faces of the spray head are oriented.

15. The sprayer nozzle system of claim 8, wherein at least one of the one of more spray shafts has a length of at least five inches.

16. A method of operating a sprayer nozzle to spray a liquid, the method comprising:

a) providing a hose;

b) providing a sprayer nozzle, comprising:

i) a handle grip having a central longitudinal axis, a first end configured for connection to the hose, a second end, and a first side and a second side opposed about the central longitudinal axis;

ii) a spray head connected to the second end of the handle grip;

iii) a first lever and a second lever attached to the handle grip and interposed between the first end and the second end of the handle grip, the first lever protruding from the first side and the second lever protruding from the second side; and, iv) wherein each of the first lever and the second lever are configured to turn on and off and control the flow of liquid from the spray head of the sprayer nozzle;

c) connecting the first end of the handle grip to the hose;

d) holding the handle grip in only one hand; and, e) operating the first lever or the second lever from either side of the sprayer nozzle with only a single finger of the hand holding the handle grip to turn on and off and control the flow of liquid from the spray head of the sprayer nozzle.

17. The method of claim 16, further comprising:

in b), the spray head including a spray shaft configured for attachment to and detachment from the second end of the handle grip; and, attaching the spray shaft of the spray head to the second end of the handle grip.

18. The method of claim 17, further comprising:

in b), a plurality of detachable spray shafts each configured for attachment to and detachment from the second end of the handle grip;

detaching one of the plurality of spray shafts to the second end of the handle grip; and, attaching another one of the plurality of spray shafts to the second end of the handle grip.

* * * * *